US006135921A

United States Patent [19]

Holland et al.

[11] Patent Number: 6,135,921

[45] Date of Patent: Oct. 24, 2000

[54] LONG JUMP TRAINING APPARATUS

[76] Inventors: Dennis Holland, 222 Laniloa Way, Haiku, Hi. 96708; Neil LaBelle, 131 Rose St., Morse Bluff, Nebr. 68648

[21] Appl. No.: 09/203,446

[22] Filed: Dec. 1, 1998

[51] Int. Cl.[7] ..... A63B 5/00

[52] U.S. Cl. ..... 482/15; 482/14; 482/16

[58] Field of Search ..... 482/14, 15, 16, 482/17, 34, 35, 36, 37, 23, 24, 83; 473/422, 440, 442, 443

[56] References Cited

U.S. PATENT DOCUMENTS

| | | | |
|---|---|---|---|
| 425,636 | 4/1890 | Shaw | 482/83 |
| 2,327,253 | 8/1943 | Eisel | 482/24 |
| 2,752,155 | 6/1956 | Nedwick | 473/440 |
| 3,105,682 | 10/1963 | Ahrens | 482/17 |
| 3,304,089 | 2/1967 | Smith | 473/440 |
| 3,433,480 | 3/1969 | Coleman et al. | 482/14 |
| 3,451,677 | 6/1969 | Nedwick | 473/440 |
| 3,999,755 | 12/1976 | Shealy, Jr. | 473/440 |
| 4,004,800 | 1/1977 | Hanner . | |
| 4,168,061 | 9/1979 | Gordon | 482/15 |
| 4,892,302 | 1/1990 | Daigle | 482/15 |
| 5,634,872 | 6/1997 | Brown . | |
| 5,888,152 | 3/1999 | Rogers et al. | 473/440 |

FOREIGN PATENT DOCUMENTS

| | | | |
|---|---|---|---|
| 54-44939 | 9/1979 | Japan . | |
| 1535553 | 1/1990 | U.S.S.R. | 482/14 |

*Primary Examiner*—Justine R. Yu

[57] ABSTRACT

An apparatus for assisting an individual in training for a long jump, wherein the long jump includes a long jump runway and a long jump pit. The training apparatus includes a launching board positioned on the runway to propel a jumper into the apparatus. The apparatus has a frame assembly with a top portion, a bottom portion, a front portion, and a pair of opposing side portions. Each of the side portions has a lower flexible member extending therefrom which is positioned to allow a jumper's respective legs to pass thereover. The frame assembly also has an upper flexible member positioned to contact a jumper's chest. Alternatively, the training apparatus includes a plurality of separate movable elements, instead of an integral frame assembly.

42 Claims, 5 Drawing Sheets

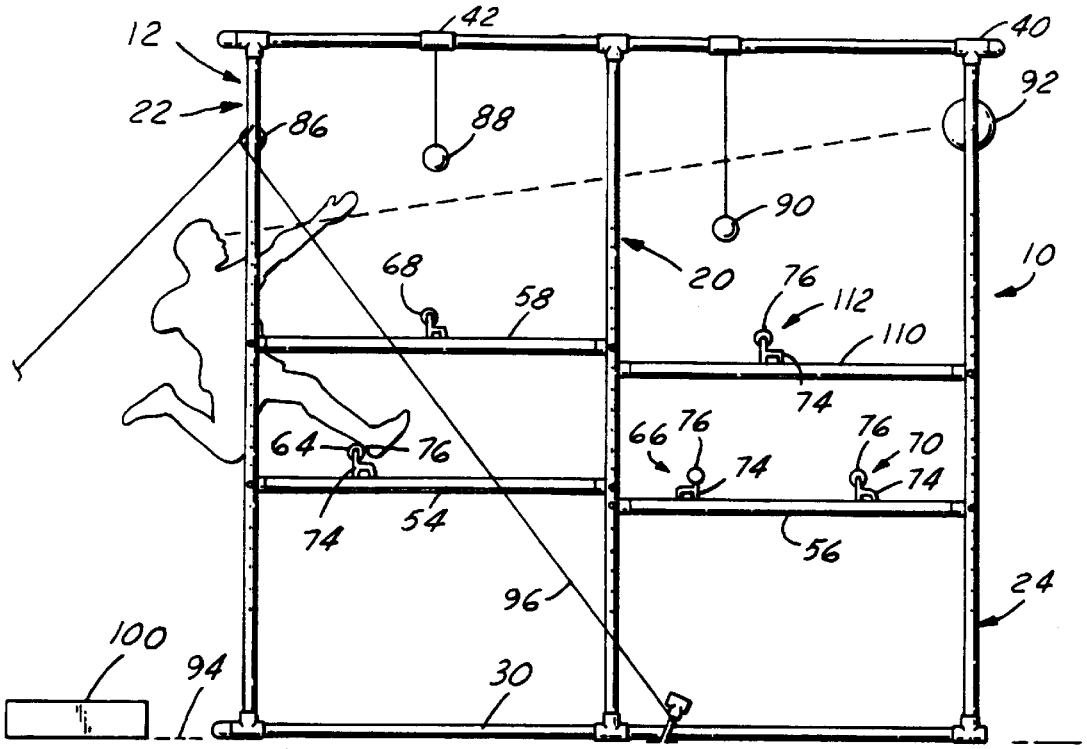
FIG. 5
FIG. 6
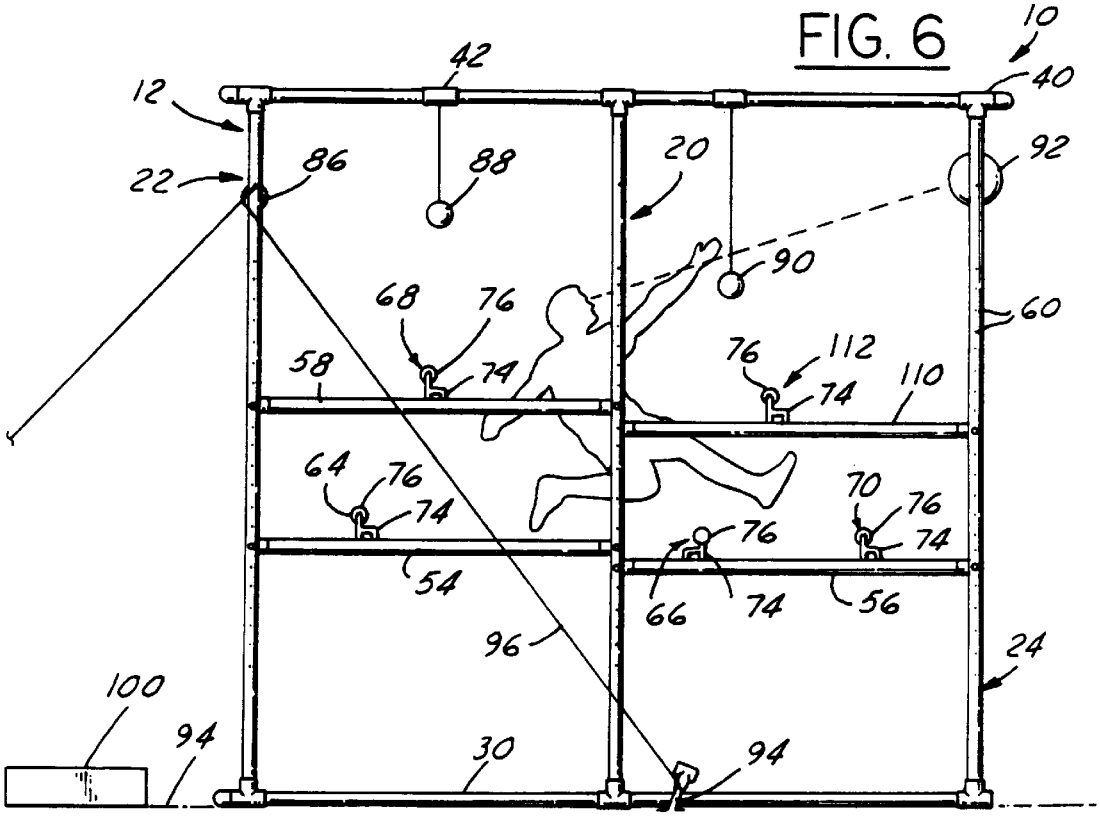

LONG JUMP TRAINING APPARATUS

TECHNICAL FIELD

The present invention relates to an apparatus for use by long jumpers to improve their jumping technique and increase the distance that they are able to jump.

BACKGROUND ART

There are a variety of known methods and apparatus that are used to help individuals improve their vertical leap, i.e., the distance they can jump off the ground. Such devices are very rudimentary and include, for example a rotating pole that an individual must leap over as it rotates through 360°, as disclosed in Japanese application No. 52-109657. Other devices include a group of height indicators positioned a certain distance in the air on a vertical pole. The indicators are stacked one on top of another, with each height indicator representing a particular height. The device is designed for individuals to leap from a position with both feet on the ground and reach to the highest indicator they are able. The indicator that they reach represents the height of their vertical leap.

While these devices are designed to measure and improve an individual's vertical leap, they are not designed to improve a person's ability to jump longer distances in a horizontal distance, such as is measured by a long jump. In order to maximize the distance that an individual can long jump, they need to combine speed down the runway, a proper trajectory take off from the board, and proper body position in the air before landing in the long jump pit. There are no known apparatus that allow individuals to work on each of these areas and thus improve the distance that they can long jump. Such an apparatus would be particularly helpful in training high school and college athletes to improve their technique and thus improve their performance in competitions.

SUMMARY OF THE INVENTION

The present invention is directed to overcoming one or more of the problems as set forth above. It is an object of the present invention to provide a long jump training apparatus that will allow an individual to improve his or her jumping technique and therefore increase the long jumping distance.

In accordance with the objects of the present invention, a long jump training apparatus is provided. The long jump training apparatus is positioned over the landing pit in a long jump alley and includes a frame assembly having a top portion, a bottom portion, an open front portion, and a pair of opposing side portions. The front portion of the frame assembly is positioned such that a jumper running toward the long jump pit down a runway can spring off a take off board or other launching device into the training apparatus through the front portion of the frame assembly. The frame assembly includes one or more lower flexible members that extend inwardly from one or both of the pair of opposing side portions and an upper flexible member that extends inwardly from one of the pair of opposing side portions.

The lower flexible members are positioned so that the long jumper can step over them in the air one leg at a time. The upper flexible member is positioned to contact the jumper's chest. One or more targets, such as balls or similar objects are also positioned to hang into the frame assembly from the top portion. The balls are positioned so the long jumper can reach for them with his or her hands and focus on another with his or her eyes.

The location of the flexible members and balls can be adjusted on the frame assembly as desired by the jumper or the coach. Adjustment mechanisms are provided, such as posts and holes, elongated slots, and the like for accomplishing this adjustment.

In accordance with the objects of the present invention, the top and side portions of the long jump training apparatus include a plurality of cross members. The cross members provide bars or structural supporting members for the flexible members and hanging balls. The hanging balls and flexible members can be adjusted to various heights and locations so that the training apparatus can be utilized by people having different techniques and physical abilities.

In a further embodiment, the long jump training apparatus includes a plurality of stantion devices. The stantion devices include a base portion which is designed to be positioned outside the long jump pit. Each of the stantion devices includes at least one lower flexible member and at least one upper flexible member that extends over the long jump pit. Each stantion also includes a hanging ball which also extends over the long jump pit. The stantions may be easily moved along the sides of the long jump pit to accommodate jumpers of various sizes and ability.

Additional objects and features of the present invention will become apparent upon review of the drawings and accompanying detailed description of the preferred embodiments.

BRIEF DESCRIPTION OF THE DRAWINGS

FIG. 5 illustrates the use of long jump training apparatus of the present invention by a long jumper shortly after the jumper has jumped off the take off board;

FIG. 6 illustrates the use of the long jump training apparatus of the present invention as the jumper is further along in his jump;

DETAILED DESCRIPTION OF THE PREFERRED EMBODIMENTS

Figure 1:
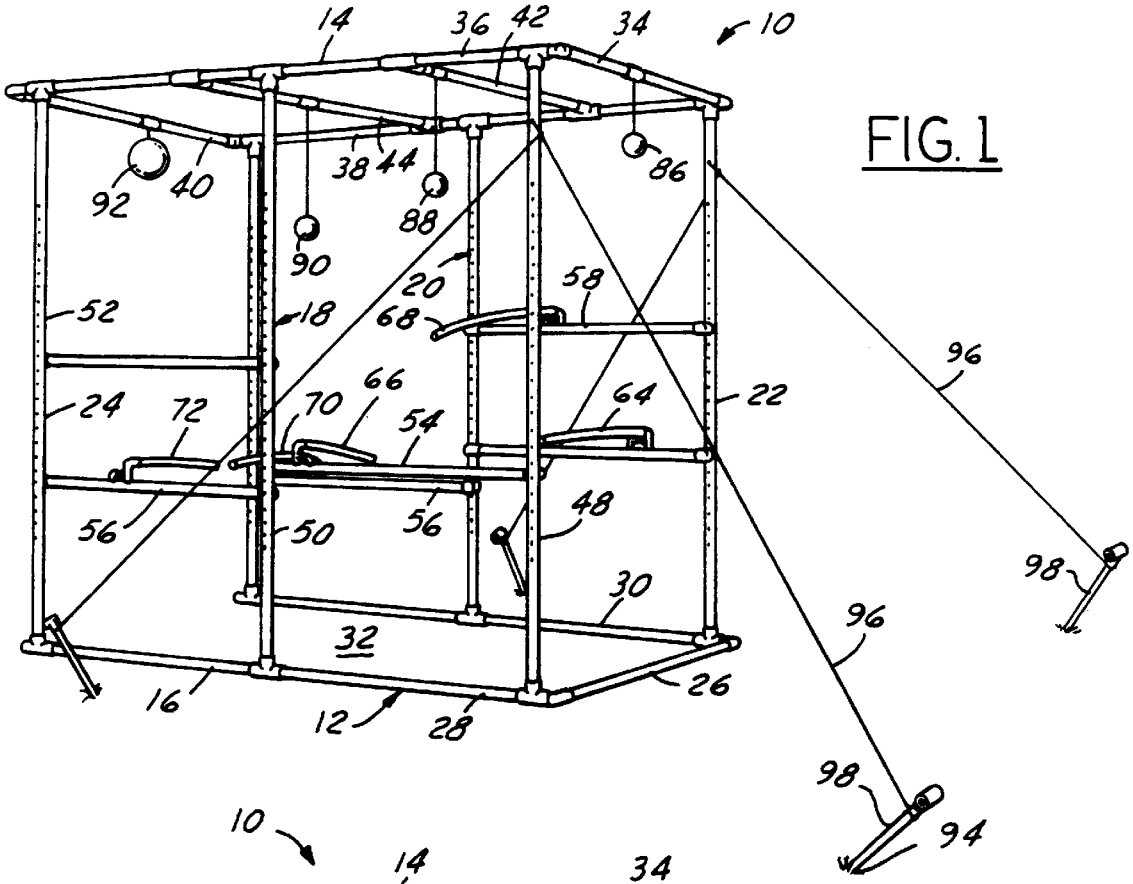
FIG. 1 is a perspective view of a long jump training apparatus in accordance with a preferred embodiment of the present invention.
Figure 2:
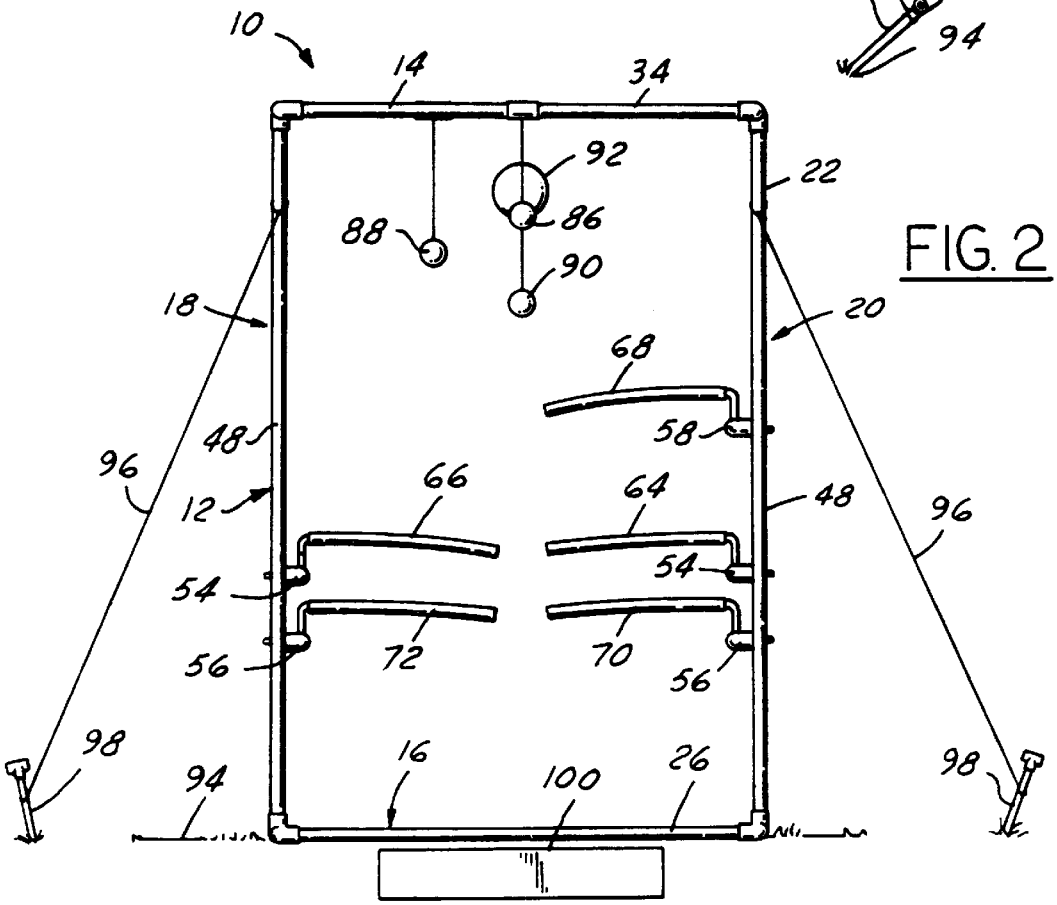
FIG. 2 is a front view of a long jump training apparatus in accordance with a preferred embodiment of the present invention.

FIGS. 1 and 2 illustrate a long jump training apparatus 10 in accordance with a preferred embodiment of the present invention. The training apparatus is preferably positioned over a long jump pit so that a jumper can also practice his landings in the sand. It should be understood, however, that the apparatus can be positioned in any location to allow a jumper to practice his technique, including for example, over mats, other padded materials, or a body of water.

The long jump training apparatus includes a frame assembly 12, having a top portion 14, a bottom portion 16, a pair of opposing side portions 18, 20, a front portion 22, and a rear portion 24. The bottom portion 16 is preferably generally rectangular in shape and includes a front base piece 26 and a pair of side base pieces 28, 30. The bottom portion 16 is preferably sized so that the front base piece 26 and the pair of side base pieces 28, 30 rest on the sand in the long jump pit 32. However, the bottom portion 16 may be sized so that all or some of the base pieces 26, 28, and 30 rest on the periphery of the long jump pit. Alternatively, the front base piece 26 and the side base pieces 28, 30 can rest on the ground outside and therefore surrounding the periphery of the long jump pit 32. The bottom portion 16 may be configured in a variety of different shapes, including circular or oval and may also have more or less base pieces.

The top portion 14 is also preferably generally rectangular in shape and lies in a plane parallel to the bottom portion 16. The top portion 14 has a front top piece 34, a pair of opposing side top pieces 36, 38, and a rear top piece 40. The top portion 14 preferably has two cross members 42, 44 that extend between the side top pieces 36, 38. It should be understood that more or less cross member 42, 44 or that more or less side top pieces 36, 38 may be utilized. Similarly, the front top piece 34 and/or the back top piece 40 may be removed without departing from the scope of the present invention.

Figure 4:
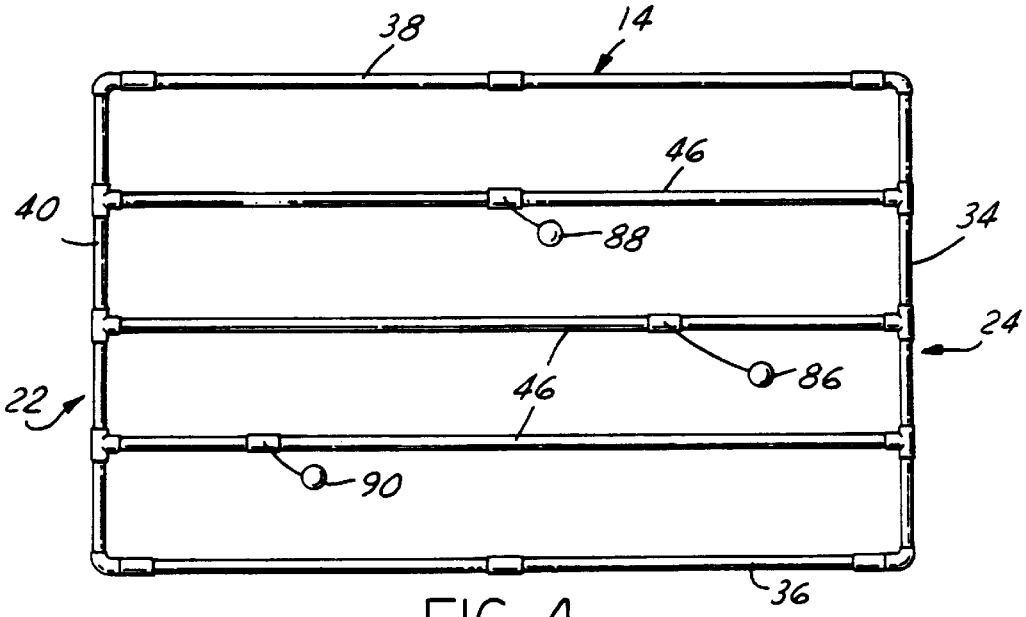
FIG. 4 is an illustration of the top portion of the frame assembly in accordance with an alternative embodiment of the present invention.

Alternatively, as shown in FIG. 4, a plurality of cross members 46 can extend between the front top piece 34 to the back top piece 40. As with the bottom portion 16, the top portion 14 may be formed in any shape, including circular or oval. Moreover, the top portion 14 may be larger or smaller then the bottom portion 16 and may be comprised of a different shape than the bottom portion 16.

In general, the frame assembly 12 comprises an outer structural framework with a hollow interior and open front and rear ends and is positioned over a long jump pit.

Each of the opposing side portions 18, 20 preferably include a front support beam 48, a middle support beam 50, and a rear support beam 52. The opposing side portions 18, 20 are mirror images of one another. Therefore, a description of one side will apply equally to the other side, except as otherwise noted. The walls or side portions 18, 20 of the frame assembly 12 can be constructed of open frame members, as shown, or the side portions may be solid, thus enclosing the frame assembly. The side portions 18, 20 are preferably constructed from an open framework since this produces a lighter device and one which is easy to assembly and disassemble for transport and storage. The open side portions 18, 20 also allow a coach, advisor, or trainer, to watch a jumper's technique.

The side portion 18 preferably has a first support bar 54, that extends between the front support beam 48 and the middle support beam 50. The front support bar 54 is attached to the front and middle support beams 48, 50, as shown in more detail in FIG. 3. The front support beam 48, the middle support beam 50, and the rear support beam 52, each have a plurality of holes 60 formed therein allowing for attachment of the ends of the support bars thereto. In order to effectuate attachment, the front support bar 54, for example, has a peg 62 formed at each of its ends to be telescopically received within the holes 60 on the support beams 48, 50, 52. The peg 62 preferably extends through the middle support beam 50 so that a locking device (not shown) may be placed on the end of the peg 62 to prevent it from becoming dislodged. The first support bar 54 also has a peg 62 formed at its other end for attachment to the front support beam 48. Additionally, instead of a locking device, the pegs 62 may be fit through the respective beam to facilitate easy adjustment of the bars.

A rear support bar 56 extends between the middle support beam 50 and the rear support beam 52. The rear support bar 56 has pegs 62 formed at each of its end in the same manner as described above in connection with the front support bar 54. The rear support bar 56 is attached to the middle and rear support beams 50, 52 in the same manner as the front support bar 54 is attached to the front and middle support beams 48, 50. Specifically, the rear support beam 52, like the middle support beam 50, has holes 60 formed therein for telescopically receiving the pegs 62 of the rear support bar 56. The rear support bar 56 preferably lies in a plane parallel to the front support bar 54, but is positioned lower or closer to the ground than the front support bar 54. Instead of a plurality of holes 60, the support beams could instead include a channel with notches that would allow the support bars to be slid along the channel and locked into a notch for adjustment purposes. Alternatively, the support bars could be adjustable through the use of movable braces which slide over the beams.

A front upper support bar 58 is preferably formed between the front support beam 48 and the middle support beam 52 of one of the opposing sides 18, 20. The front upper support bar 58 is attached to the support beams 50, 52 in the same manner that the front and rear support bars 54, 56 are attached to the frame assembly 12. It should be understood that alternative arrangements for attaching the support bars to the frame assembly 12 may be utilized. The front upper support bar 58 is preferably positioned above the front support bar 54. As shown in FIGS. 1 and 2, the front upper support bar 58 is positioned on the side portion 20, however, the front upper support bar 58 may instead be positioned on the side portion 18. Alternatively, a front upper support bar 58 may be positioned on each of the opposing side portions 18, 20.

Figure 3:
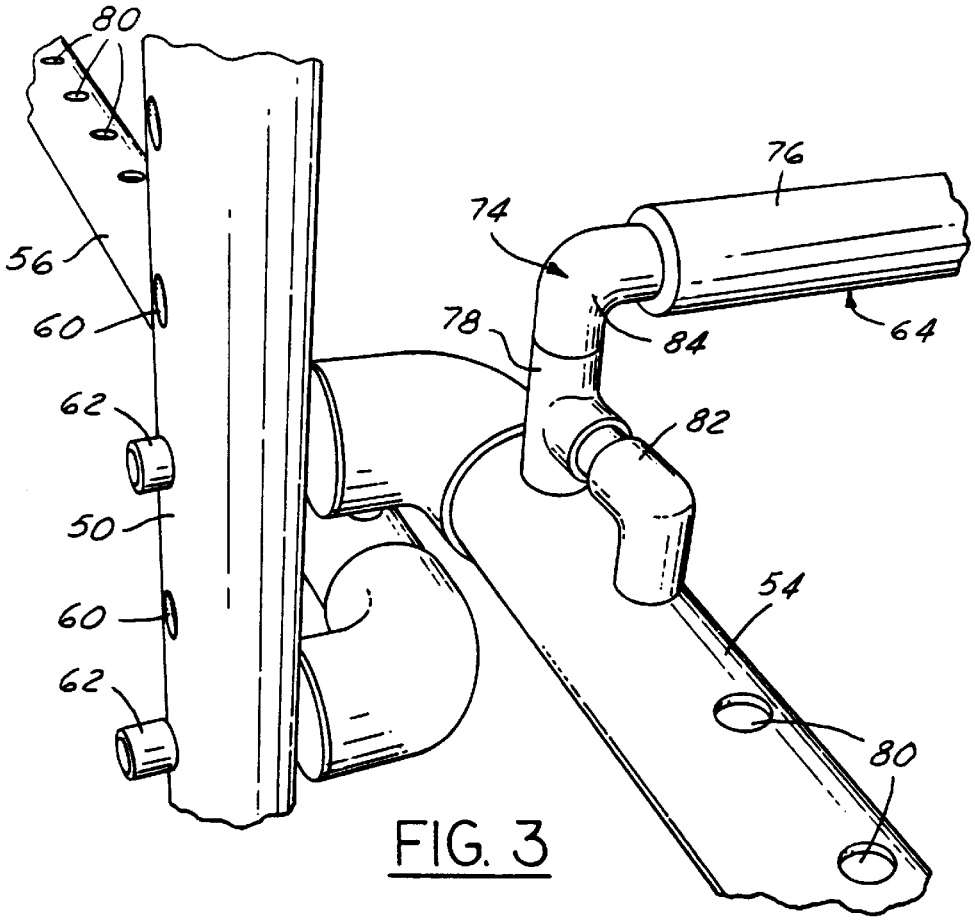
FIG. 3 is an enlarged view of a portion of the long jump training apparatus illustrating the attachment of one of the flexible members to a frame assembly in accordance with a preferred embodiment of the present invention.

A first lower flexible member 64 is preferably attached to the front support bar 54. As shown in FIGS. 1 through 3, the first lower flexible member 64 is shown attached to the front support bar 54 of the side portion 20 and extending generally inward toward the opposing side portion 18. The first lower flexible member 64 may also be positioned on the front support bar 54 of the side portion 18.

A second lower flexible member 66 is preferably attached to the front support bar 54 of the side portion 18 and is positioned rearwardly with respect to the first lower flexible member 64. A front upper flexible member 68 is preferably attached to the front upper support bar 58 of the side portion 20. A first rear flexible member 70 is attached to the rear support bar 56 of the side portion 20. A second rear flexible member 72 is attached to the third support bar 56 of the side portion 18.

The flexible members 64, 66, 68, 70, and 72 preferably include a solid end portion 74 that attaches the respective flexible member to its respective support bar and a padded portion 76 that extends generally inward towards the center of the frame assembly 12 (FIG. 3). The end portion 74 is preferably made from a synthetic nylon, such as plastic, or a metal material. The padded portion 76 is preferably constructed of a soft material, such as foam or the like. Alternatively, the flexible portion may be constructed of a rubber material, such as rubber tubing. The flexible members 64, 66, 68, 70, and 72 may be configured to quickly disconnect from the assembly 12, or they may be permanently attached.

As shown in FIG. 3, the end portions 74 are preferably comprised of a first section 78 that is attached to the respective support bar, such as the front support bar 54. The first section 78 is received in a hole 80 formed on the front support bar 54. Each of the support bars has a plurality of holes 80 formed along its length. The first section 78 has an adjoining arm portion 82 that fits into an adjacent hole 80 on the front support bar 54. Other known attachment methods may be utilized that eliminate the adjoining arm portion 82. The first section 78 is in rotateable communication with a second section 84. The second section 84 is rotateable about the first section 78 at one end and at its other end is telescopically received within the padded portion 76 of one of the flexible members. Instead of a plurality of holes 60, the support bars can alternatively include a channel with notches that would allow the flexible members to be slid along the channel and locked into a notch for adjustment purposes. The flexible members may also be adjusted along the support bars through the use of movable bars that slide over the beams.

The flexible members can be positioned anywhere along the respective support bar they are in communication with. As illustrated in FIG. 3, the first lower flexible member 64 is positioned at the rear of the front support bar 54 of the side portion 18. However, it may be adjusted as desired in any manner as described above. Similarly, the front support bar 54 and the rear support bar 56 may be adjusted to different positions along the middle support beam 50 through quick disconnection, sliding, or other like means. While the first flexible member 64 is shown and described in FIG. 3, the same attachment and configuration applies to the other flexible members 66, 68, 70, 72.

The top portion 14 of the frame assembly 12 preferably has a plurality of objects, such as balls, hanging therefrom. As shown in FIGS. 1 and 2, a first hanging ball 86 is preferably suspended from the front top piece 34. The first hanging ball 86 is preferably attached to the top portion 14 by a bracket, which is slideable along the front top piece 34. The first hanging ball 86 is positioned in the middle of the front top piece 34, i.e. equidistant between the opposing side portions 18, 20. It should be understood that the first hanging ball 86 may positioned at other locations along the front top piece 34. The first hanging ball 86 may also be suspended from different portions of the top portion 14, as will be discussed in more detail below. Moreover, the hanging balls can be permanently attached or they can be adjustable through sliding or quick disconnection. Any known attachment means may be substituted instead of the bracket. Additionally, the hanging balls can be replaced with any other object other than balls, including straps, rubber hoses, or any other object that will provide a target for the jumper's hands and eyes.

A second hanging ball 88 is preferably suspended from the first cross member 42 and is preferably positioned closer to the side portion 18 than side portion 20. The second hanging ball 88 hangs lower than the first hanging ball 86. A third hanging ball 90 is also preferably suspended from the second cross member 44 and is positioned in the middle of the front top piece 34. The third hanging ball 90 hangs lower than the second hanging ball 88. A sight ball 92 is suspended from the rear top piece 40. All of the balls are adjustable and may be positioned at different locations along the top portion 14. The balls can also be positioned at different heights from the ground. Additionally, more or less balls or objects may be included.

The frame assembly 12, including all of the parts of the top portion 12, the bottom portion 14, the opposing side portions 16, 18, the front portion 22, and the rear portion 24 are preferably constructed from a synthetic material, such as PVC piping or the like. However, the frame assembly 12 and its portions may be constructed from different materials, such as other plastics, metal or wood. Additionally, the frame assembly 12 is preferably anchored to the ground 94 by a plurality of support wires 96 and stakes 98. The support wires 96 are preferably attached at one end to one or more of the support beams 48, 50, 52 of each of the opposing side portions 18, 20 and then anchored at the other end by a stake 98 to the ground 94. The support wires 96 may obviously be attached to other portions of the frame assembly 12 to secure it to the ground 94.

An alternative embodiment of the top portion 14 is shown in FIG. 4. In this embodiment, the hanging balls 86, 88, and 90 are positioned along cross members 46 that extend from the front portion 22 of the frame assembly 12 to the rear portion 24 of the frame assembly 12. Accordingly, the hanging balls that are suspended from these cross member 46 may be adjusted by sliding them along their respective cross member 46. As with the hanging balls described above, these hanging balls may also be entirely removed from their respective cross member 46 and located on another cross member 46 or at another location on the top portion 14.

Figure 7:
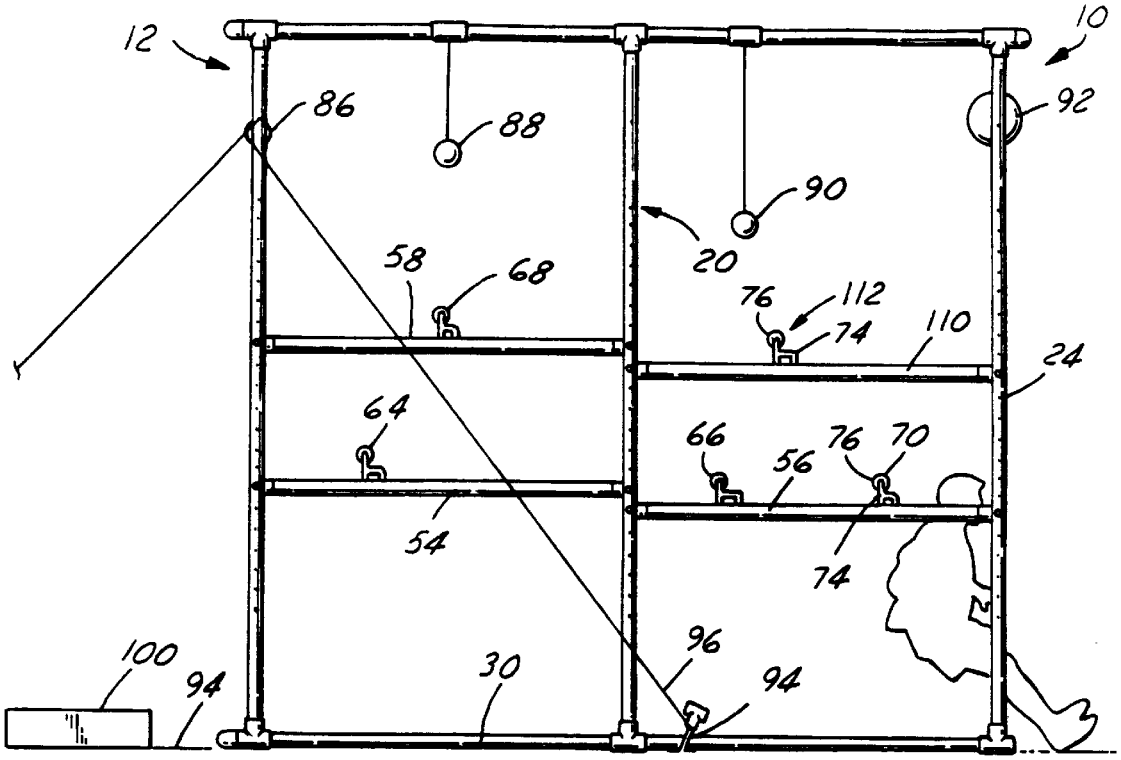
FIG. 7 illustrates the long jump training apparatus of the present invention with a jumper descending toward the long jump pit.

Because the long jump training apparatus 10 is adjustable it can be readily configured to accommodate a long jumper who uses the left foot or the right foot as the take off foot. FIGS. 5 to 7 generally illustrate the sequence through and the position of an individual as he travels through the apparatus 10, in accordance with the objects of the present invention. The long jump training apparatus is configured for a long jumper (shown schematically) who takes off from the launching board 100 with his left foot, as shown in FIG. 5, and is practicing a scissors kick long jump technique. For training purposes a springboard 100 can be used to help an individual gain more height. Other devices that can assist an individual in gaining extra height, such as a trampoline springboard, or the like, can be utilized. Additionally, the long jump training apparatus 10 could have wheels or slides mounted thereon for ease of movement and portability.

FIG. 5 illustrates the position of a jumper after he has left the springboard 100. The jumper is entering the frame assembly 12, through the front portion 22. The jumper's lead leg or non-take off leg (in this case the right leg) is designed to pass over the first flexible member 64, which is extending inwardly from the front support bar 54 of the side portion 20. The first flexible member 64 is positioned in holes 60 on the forward portion of the front support bar 54. The first flexible member 64 can be adjusted and moved forward or backward by placing it in different holes 60. Obviously, if the jumper takes off from the springboard 100 with his left leg, the first lower flexible member 64 should be attached to the front lower support bar 54 on the side portion 18. Alternatively, a first flexible member 64 may extend inwardly from a front support bar 54 that is positioned on each side portion 18, 20.

The padded portion 76 of the first lower flexible member 64 is designed to deflect or bend if the jumper is unable to clear the member 64. Additionally, the first lower flexible member 64 will rotate about its and portion 74 if contacted by the jumper. While the jumper's lead leg (right leg in this case) is passing over the first lower flexible member 64, his opposite hand (left hand) should be reaching for the first hanging ball 86, hanging from the first cross member 42. All the while, the jumper is supposed to keep his eye on the sight ball 92 hanging from the rear top piece 40 of the top portion 14.

While not shown, the jumper's chest is supposed to contact the first upper flexible member 68. When the jumper's chest contacts the first upper flexible member 68, the padded portion 76 cushions any force against the jumper's chest, while the first upper flexible member 68 rotates out of the way around its end portion 74. The first upper flexible member 68 is shown extending from the front upper support bar 58 which is positioned on the side portion 20. However, the first upper flexible member 68 may be positioned on either side portion 18, 20 regardless of which leg is the jumper's lead leg. The first upper flexible member 68 is also adjustable along the holes provided in the front upper support bar 58. The flexible members are intended to provide as little resistance as possible, so that the jumper's momentum is impeded as little as possible.

As the jumper contacts the first upper flexible member 68, the jumper's right hand should be reaching for the second hanging ball 88. The second hanging ball 88 is positioned lower than the first hanging ball 86, because the jumper will slowly be traveling downward as he continues forward in the pit. Thus, the subsequent hanging balls are positioned lower so that the jumper has a chance to reach them.

As shown in FIG. 6, after the jumper contacts the first upper flexible member 68, the jumper's take-off leg (in this case his left leg) should now be the leading leg, with his right leg trailing as the jumper prepares to place his left leg over the flexible member 66. The second lower flexible member 66 is attached to the rear lower support bar 56 of the side portion 18. However, the second lower flexible member 66 can extend inwardly from the side portion 20 for a jumper with a different lead leg. Additionally, the second lower flexible member 66 may be positioned on the front lower support bar 54. At this time, the jumper's right hand should be reaching for the third hanging ball 90 suspended from the second cross member 49.

After the jumper's left leg and body clears the second lower flexible member 66, the right leg should also come forward so that both feet are together so that they both can pass over the first and second rear lower flexible members 70, 72 (FIG. 7). As the feet come together, both the jumper's hands should be in front of him reaching up and out. Obviously, different jumpers will assume different positions as they travel through the frame assembly 12 of the training apparatus 10. The first rear lower flexible member 70 is attached to and extends from the rear lower support bar 56 of side portion 20, while the second rear lower flexible member 72 is attached to and extends from the opposing side portion 20. The first and second rear lower flexible members 70, 72 are positioned so that they lie in the same generally parallel plane.

The rear lower members 70, 72 each have padded portions 76 that are designed to protect the jumper's legs if they are unable to clear the members 70, 72. Additionally, the first and second rear lower flexible members 70, 72 can rotate about their end portions 74 if contacted by the jumper, to further protect the jumper from harm. Additionally, the rear lower members 70, 72 can each be adjusted to different positions along their respective rear lower support bars 56 by placing them in the appropriate holes 60.

It should be understood that any number of flexible members and support bars may be included. As shown in FIGS. 5 through 7, an upper rear support bar 110 is preferably included. The upper rear support bar 110 may be located on either opposing side 18, 20 or both. An upper rear flexible member 112 is preferably mounted on the upper rear support bar 110 to contact a jumper's chest as he is passing over the second lower flexible member 66. The upper rear support bar 110 is preferably positioned lower than the upper front support bar 58.

FIGS. 8–11 refer to an alternative embodiment in accordance with the present invention. In this embodiment, the long jump training apparatus 200 includes a plurality of stantion elements. In the preferred embodiment, four stantion elements 202, 204, 206, 208 are included. Two stantion elements are front elements 202, 204 and two stantion elements 206, 208 are rear elements. However, more or less stantion elements may be utilized and in different positions. As with the prior embodiments, the training apparatus is positioned over a long jump pit 32. The individual stantions are individually movable and may therefore be advantageous over the prior unitary embodiment described in connection with FIGS. 1 through 7.

Figure 8:
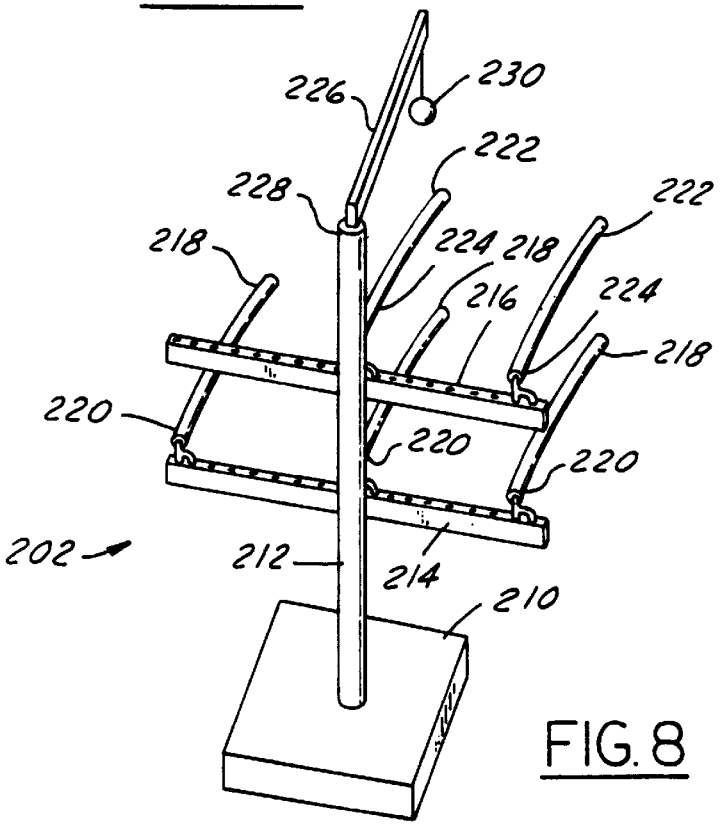
FIG. 8 is a perspective view of one element of an alternate long jump training apparatus in accordance with a preferred embodiment of the present invention.
Figure 9:
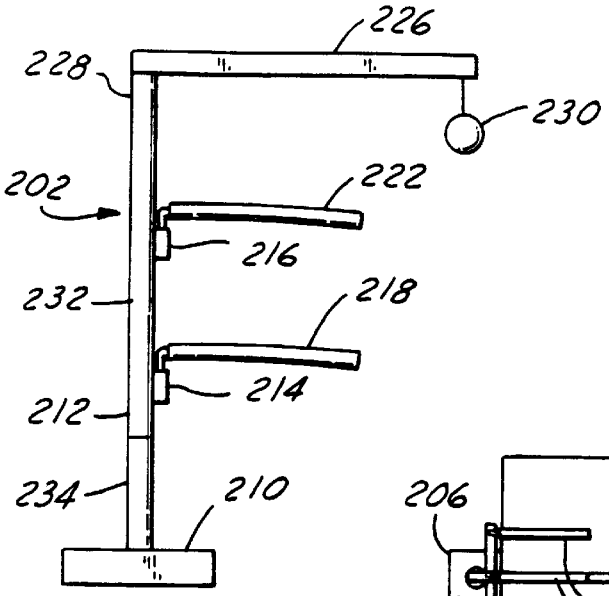
FIG. 9 is a front view of one element of an alternate long jump training apparatus in accordance with a preferred embodiment of the present invention.

Each of the stantion elements 202, 204, 206, and 208 are illustrated as identical and therefore only stantion element 202, as shown in FIGS. 8 and 9, will be individually described. The stantion element 202 has a base portion 210 an upright portion 212, a lower crossbar 214, and an upper crossbar 216. The lower crossbar 214 supports a plurality of flexible members 218, such as the first lower flexible member 64 and the second lower flexible member 66 which were previously described. The base portion 210 has the same function as the bottom portion 16 and the upright portion 212 performs the same function as the same as the front, middle and rear beams 48, 50, 52.

As shown in FIG. 8, the lower crossbar 214 has at least one flexible member 218 attached thereto. While the drawings show three flexible members 218, any number of flexible members may be utilized. The flexible members may be a rubber hose, padded material, or any other suitable device. Like with the prior embodiment, the flexible members 218 are attached to the lower crossbar 214 and are rotatable about their respective attachment end 220. The attachment of the flexible members 218 to lower crossbar 214, may be accomplished by any known means such as was described and shown in connection with FIG. 3. Additionally, the attachment of the flexible members 218 may be permanent as the individual stantion elements are moveable, which may eliminate the need to adjust the flexible members.

A plurality of upper flexible members 222 are attached to the upper crossbar 216 of the stantion 202. The upper flexible members 222 are also preferably constructed of a rubber hose, padded material or the like. The upper flexible members 222 are attached to the upper crossbar 216 at an attachment end 224 and are rotatable thereabout. As with the lower flexible members 218, the upper flexible members 222 are preferably attached to the upper crossbar 216 by the mechanism shown in FIG. 3 and described previously herein, however, any known attachment means is acceptable, including permanent attachment.

The stantion element 202 has a ball support portion 226. The ball support portion 206 is rotatable about the upper end 228 of the upright portion 212. The upper end 228 of the upright portion 212 is preferably telescoping such that the ball support portion 226 may be raised and lowered as necessary. The ball support 226 has a hanging ball 230 or other hanging object suspended therefrom.

The lower flexible members 218 are designed so that a jumper's leg will pass thereover. The upper flexible members 222 are designed to engage the jumper's chest and the hanging ball 230 is designed for a jumper to reach for or to keep within his sight if the stantion element 202 is at the rear of the long jump pit 209. Each stantion element 202, 204, 206 and 208 is preferably comprised of a plastic material, such as PVC piping. However, the stantion elements may be constructed of wood, metal or any other suitable material. It also should be understood that the upright portion 212 may be comprised of three separate portions, an upper portion 228, a middle portion 232, and a lower portion 234. Each of these portions is preferably telescoping such that the ball support portion 226 may be adjusted up or down for a particular jumper, as may the upper flexible members 222 and the lower flexible members 218.

Figure 10:
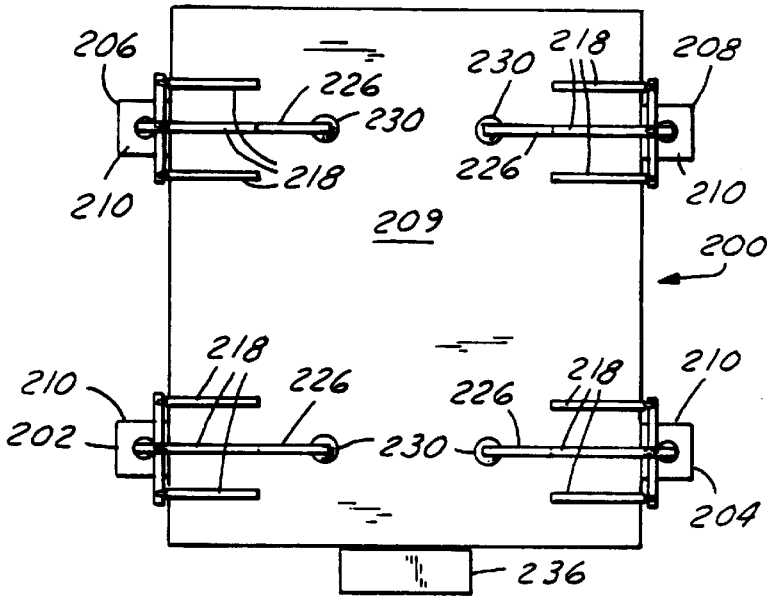
FIG. 10 is a top view of a long jump training apparatus in accordance with a preferred embodiment of the present invention.
Figure 11:
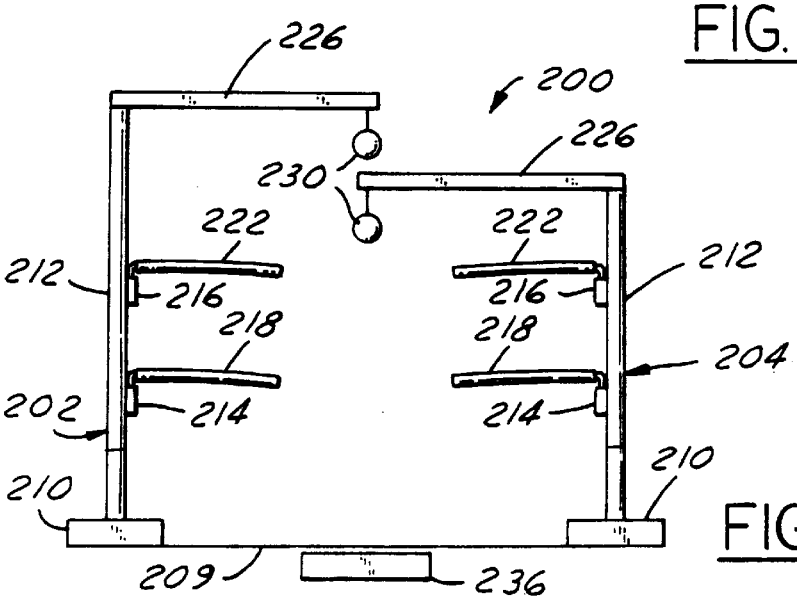
FIG. 11 is a front view of a long jump training apparatus in accordance with a preferred embodiment of the present invention.

As shown in FIGS. 10 and 11, four stantion elements are positioned around the periphery of the long jump pit 209 such that the lower flexible members 218, the upper flexible members 222, and the ball support portions 226 are all extending inwardly over the long jump pit 209. While four stantion elements are shown, any number of elements may be utilized. In operation, a jumper will run off the long jump runway and jump off a jumping board 236 over the long jump pit 209, and into communication with the long jump training apparatus 200. Depending upon which leg is the jumper's takeoff leg, the lead leg will either pass over the lower flexible members 218 of the stantion 202 or stantion 204. If the jumper's lead leg is his left leg, it will pass over the lower flexible members 218 of the stantion 204. At the same time, the hand of a jumper opposite his lead leg will be reaching for the hanging ball 230 hanging from ball support portion 226 on either stantion 202 or 204.

At the same time, the jumper's chest will be contacting the upper flexible member 222 on either stantion 202 or stantion 204 or both. The jumper's lead leg will then swing behind him as his takeoff leg will pass over the next lower flexible member 218 on the stantion 202 or 204 opposite over which his lead leg passed. The jumper's opposing arm will at this time be reaching for the hanging ball 230 on the opposing stantion 202 or 204.

Depending upon the expertise or level of skill of the jumper, four stantions may be utilized instead of two, or more or less upper flexible members may be utilized. Similarly, the front stantions 202 and 204 may be positioned with respect to the rear stantions 206 and 208 more readily than the flexible members in the prior embodiments in connection with FIGS. 1–7.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A long jump training apparatus, comprising:

a frame, including a bottom portion for supporting said frame and a top portion positioned above said bottom portion and lying in a parallel plane, said top portion being positioned such that a jumper may pass thereunder;

at least one side portion extending between said bottom portion and said top portion; and a first flexible member extending inwardly from said side portion and being positioned so that a jumper's leg is intended to pass thereover and constructed to provide substantially no resistance to the jumper's forward progress if contacted by the jumper's leg.

2. The long jump training apparatus of claim 1, wherein said first flexible member is designed for a jumper's lead leg to pass thereover.

3. The long jump training apparatus of claim 2, further comprising a second flexible member extending inwardly from said at least one side portion and positioned rearwardly with respect to said first flexible member and wherein said second flexible member is designed for a jumper's take off leg to pass thereover.

4. The long jump training apparatus of claim 3, further comprising a first hanging target in communication with said top portion of said frame, said first hanging target being positioned such that the hand opposite said jumper's lead leg can reach therefor.

5. The long jump training apparatus of claim 4, further comprising a second hanging target positioned rearwardly with respect to said first hanging target, said second hanging target being positioned such that the hand opposite said jumper's take off leg can reach therefor.

6. The long jump training apparatus of claim 2, wherein said first flexible member is rotatable when contacted by said jumper's leg.

7. The long jump training apparatus of claim 2, wherein said at least one flexible member is moveable along said at least one side portion.

8. The long jump training apparatus of claim 1, further comprising an upper flexible member positioned above said first flexible member for contacting the torso of a jumper after take off from a launching board.

9. The long jump training apparatus of claim 1, further comprising a sight ball in communication with said top portion of said frame.

10. The long jump training apparatus of claim 1, wherein said bottom portion of said frame is generally rectangular in shape.

11. The long jump training apparatus of claim 1, wherein said bottom portion of said frame is generally circular in shape.

12. An apparatus for assisting an individual in training for a long jump, wherein said long jump includes a long jump runway and a long jump pit, said apparatus comprising:

a launching board;

a frame assembly having a top portion, a bottom portion, a front portion, and a pair of opposing side portions, said top portion being positioned such that a jumper may pass thereunder;

a lower flexible member adapted to be positioned to sit beneath a jumper's lead leg after the jumper leaves said launching board, said lower flexible member constructed to provide substantially no resistance to the jumper's forward progress when contacted thereby;

an upper flexible member adapted to be positioned to contact a jumper's chest and constructed to provide substantially no resistance to the jumper's forward progress when contacted by said jumper.

13. The apparatus of claim 12, wherein said top portion, said bottom portion, said front portion, and said pair of opposing side portions are comprised of separate portions so that when assembled form said frame assembly.

14. The apparatus of claim 12, wherein said frame assembly is a unitary structure.

15. The apparatus of claim 12, further comprising a plurality of support members for securing said frame assembly to the ground.

16. The apparatus of claim 12, wherein said top portion of said frame assembly includes at least one cross member having at least one ball hanging therefrom.

17. The apparatus of claim 16, wherein said at least one cross member generally extends from said front portion of said frame assembly toward a back portion.

18. The apparatus of claim 16, wherein said at least one cross member generally extends between said pair of opposing sides.

19. The apparatus of claim 16, wherein said at least one hanging ball is adjustable and can be moved to different locations along said cross member.

20. The apparatus of claim 16, wherein said at least one hanging ball is positioned such that the jumper's hand opposite said lead leg can reach therefor.

21. The apparatus of claim 12, wherein one of said pair of opposing side portions includes a first support bar for retaining said lower flexible member in a desired position.

22. The apparatus of claim 21, wherein said lower flexible member can be moved to various locations along said first support bar.

23. The apparatus of claim 22, wherein said lower flexible member is rotateable about said first support bar to move out of the way if contacted by said jumper.

24. The apparatus of claim 22, wherein said lower flexible member is rotateable about said first support bar allowing it to move out of the way if contacted by said jumper.

25. The apparatus of claim 21, further comprising a second support bar positioned above said first support bar for retaining said upper flexible member in a desired position.

26. The apparatus of claim 25, wherein said upper flexible member is adjustable and can be moved to various locations along said second support bar.

27. The apparatus of claim 26, wherein said upper flexible member is rotateable about said second support bar to move out of the way if contacted by said jumper.

28. The apparatus of claim 26, wherein said upper flexible member is rotateable about said second support bar to move out of the way if contacted by said jumper.

29. The apparatus of claim 21, wherein the other one of said pair of opposing side portions further includes a second support bar for retaining a second lower flexible member thereon.

30. The apparatus of claim 29, wherein said second lower flexible member is positioned behind said lower flexible member with respect to said front portion of said frame assembly and is positioned to allow the jumper's take off leg to pass thereover.

31. The apparatus of claim 30, wherein said second lower support member is adjustable along said second support bar to various positions.

32. A long jump training apparatus comprising:

a base portion, a top portion attached to said at least one vertical upright and positioned above said base portion, such that a jumper may pass therebetween resting on the ground;

at least one vertical upright attached to said base portion; and at least one flexible member extending from said vertical upright and adapted to be extended over an area including a long jump pit, said at least one flexible member constructed to move away when contacted by a jumper with substantially no resistance to the jumper's forward progress.

33. The long jump training apparatus of claim 32, wherein said at least one flexible member is designed for a jumper's lead leg to pass thereover.

34. The long jump training apparatus of claim 33, further comprising:

a lower crossbar that is attached to said at least one vertical upright and to said at least one flexible member.

35. The long jump training apparatus of claim 34, further comprising:

an upper crossbar located above said lower crossbar, said upper crossbar attached to said at least one vertical upright and having at least one flexible member extending therefrom.

36. The long jump training apparatus of claim 34, further comprising wherein said top portion forming a ball support portion attached to said at least one vertical upright above said lower crossbar.

37. The long jump training apparatus of claim 36, wherein said ball support portion has an object hanging therefrom.

38. The long jump training apparatus of claim 37, wherein said ball support portion is rotatable about said at least one vertical upright.

39. The long jump training apparatus of claim 37, wherein said at least one upright has a telescoping portion that allows said ball support portion to be raised and lowered.

40. The long jump training apparatus of claim 32, wherein said base portion, said at least one vertical upright, and said at least on flexible member are each comprised of a single separate element, which when attached from the long jump training apparatus.

41. The long jump training apparatus of claim 32, wherein said base portion, said at least one vertical upright, and said at least one flexible member are part of a frame assembly.

42. A long jump training apparatus comprising:

a base portion sized to rest on or around the periphery of a long jump pit, a top portion attached to said upright portions and positioned above said base portion, such that a jumper may pass thereunder;

a plurality of upright portions connected to said base portion and extending generally upward therefrom; and at least one flexible member attached to each of said plurality of upright portions and extending over said long jump pit, each of said flexible members constructed to yield when contacted by a jumper with substantially no resistance to the jumper's forward progress.

* * * * *